United States Patent [19]

Tamura

[11] 4,048,951

[45] Sept. 20, 1977

[54] APPARATUS FOR APPLYING A GLASS FRIT TO A SEAL EDGE OF A FUNNEL PORTION OF A PICTURE TUBE

[75] Inventor: Michio Tamura, Fujisawa, Japan

[73] Assignee: Sony Corporation, Tokyo, Japan

[21] Appl. No.: 602,362

[22] Filed: Aug. 6, 1975

[30] Foreign Application Priority Data

Aug. 14, 1974 Japan ..... 49-92971

[51] Int. Cl.[2] ..... B05C 5/02; B05C 13/00

[52] U.S. Cl. ..... 118/6; 118/8; 118/321

[58] Field of Search ..... 118/8, 6, 321, 409, 118/320

[56] References Cited

U.S. PATENT DOCUMENTS

| | | | |
|---|---|---|---|
| 2,880,697 | 4/1959 | Blanding et al. | 118/320 |
| 3,324,625 | 6/1967 | Dulmage | 118/321 X |
| 3,339,522 | 9/1967 | Shaffer et al. | 118/321 X |
| 3,342,158 | 9/1967 | Bennett et al. | 118/321 X |
| 3,403,658 | 10/1968 | Damm et al. | 118/409 X |
| 3,492,146 | 1/1970 | Kornaker | 118/409 X |
| 3,575,131 | 4/1971 | Lohmann | 118/321 X |
| 3,777,702 | 12/1973 | Fitzgerald | 118/8 X |

*Primary Examiner*—John P. McIntosh

*Attorney, Agent, or Firm*—Lewis H. Eslinger; Alvin Sinderbrand

[57] ABSTRACT

Method and apparatus for applying a continuous layer of glass frit to a connection or sealing edge surface of the funnel portion of a picture tube. The glass frit flows onto such surface from a nozzle of a glass frit containing pot while the funnel portion is carried by a turntable. Means are provided for rotating the turntable at such a speed that the relative speed, between the nozzle and the connection surface positioned therebelow, is substantially inversely proportional to the width of the connection surface.

7 Claims, 7 Drawing Figures

FIG.1
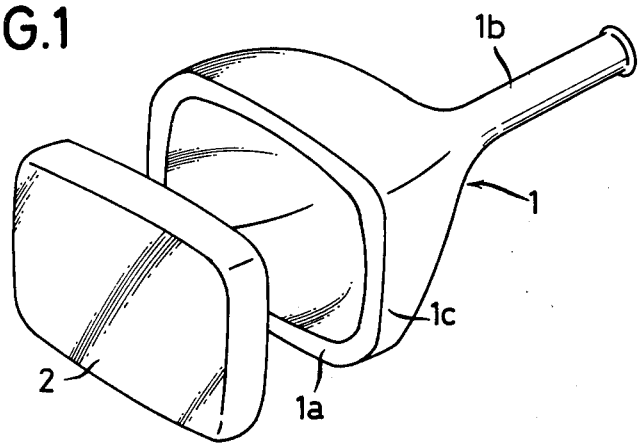
FIG.2
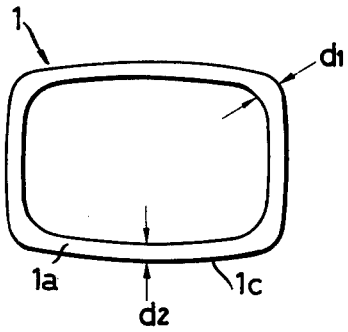
FIG.4
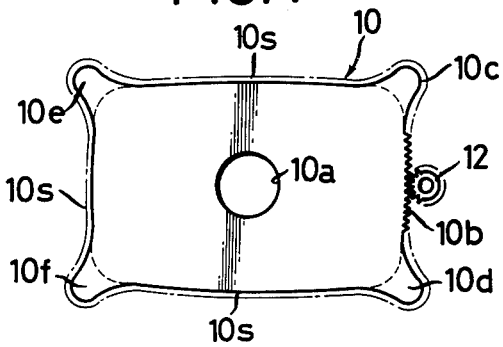
FIG.5
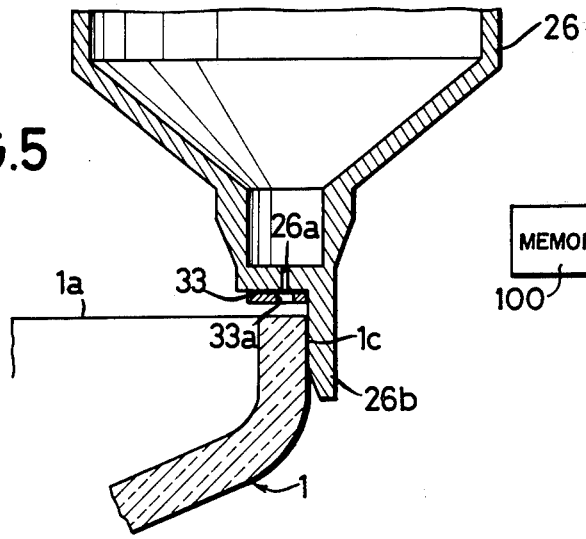
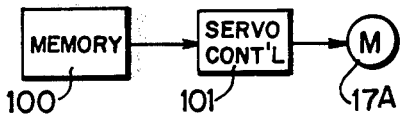
FIG.6

FIG.3
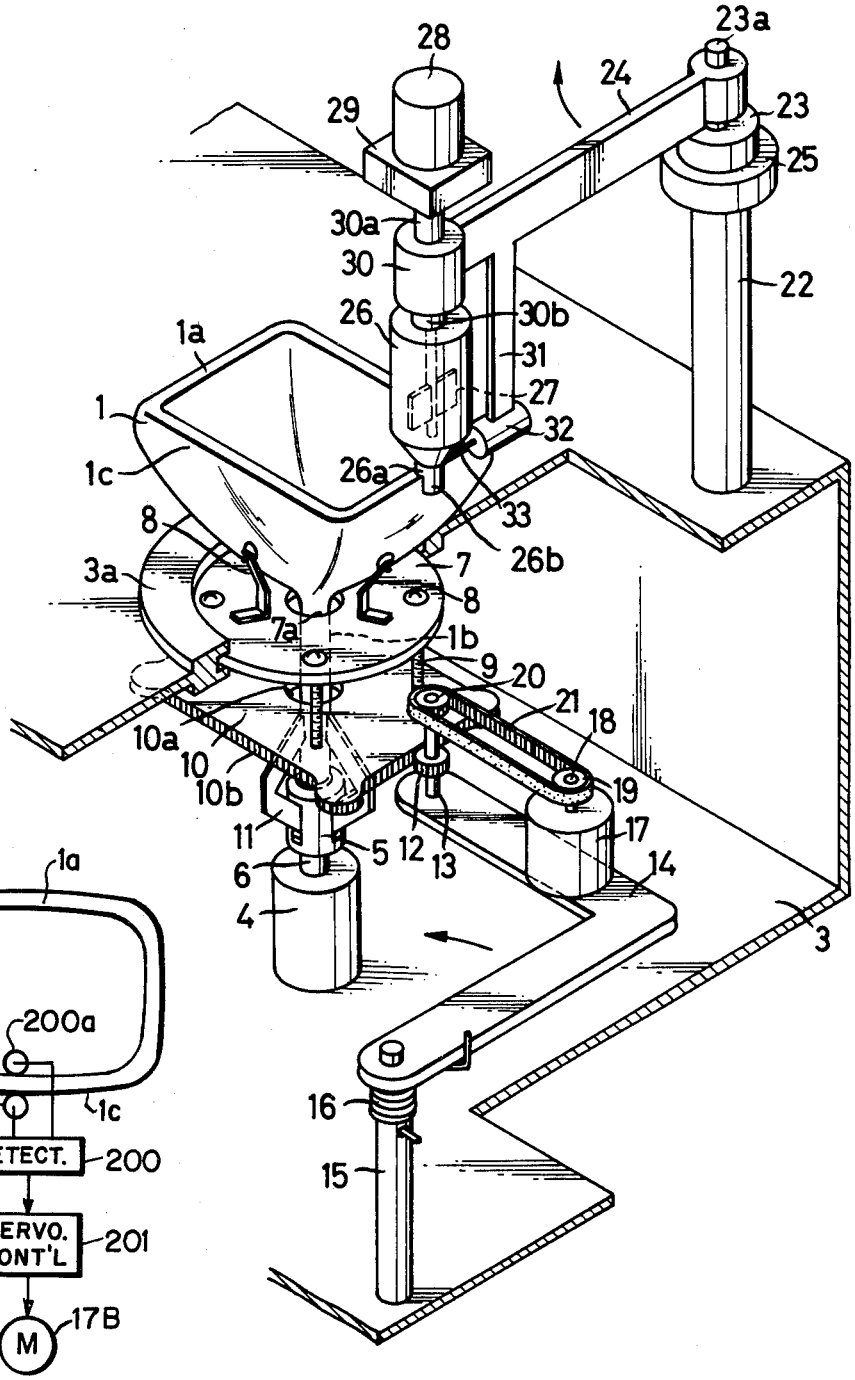
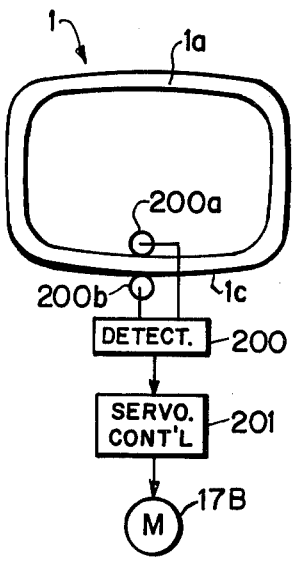
FIG. 7

APPARATUS FOR APPLYING A GLASS FRIT TO A SEAL EDGE OF A FUNNEL PORTION OF A PICTURE TUBE

BACKGROUND OF THE INVENTION

1. Field of the Invention

This invention relates to apparatus for applying a glass frit to a sealing edge on the funnel portion of a picture tube.

2. Description of the Prior Art

When a picture tube or a television cathode ray tube is manufactured, a funnel portion 1 and a nearly rectangular bowl-shaped panel portion 2 are separately formed, as shown in FIG. 1. Then, a sealing edge or an end surface 1*a* of the funnel portion 1 is adhesively fixed to a corresponding end surface of the pannel portion 2. In effecting such adhesion, the end surface 1*a* of the funnel portion 1 is coated with a so-called glass frit.

There exists a coating apparatus in which the end surface 1*a* of the funnel portion 1 is automatically coated with the glass frit. In the existing coating apparatus, the end surface 1*a* of the funnel portion 1 is directed upward while the funnel portion 1 is rotated round its central axis so that the peripheral speed of the funnel portion 1 is constant with respect to an outlet opening or nozzle of a galss frit containing pot which is disposed above the end surface 1*a* of the funnel portion 1. The glass frit containing pot is arranged so as to be movable toward and away from the central axis of the funnel portion 1 for alignment with the end surface 1*a*. The glass frit is discharged onto the end surface 1*a* of the funnel portion 1 from the outlet opening of the glass frit containing pot at a constant rate, so that the end surface 1*a* of the funnel portion 1 is coated with the glass frit.

As is apparent from FIG. 2, the width $d_1$ of end surface 1*a* at its corners is larger than the width $d_2$ at the relatively straight portions of the end surface 1*a* on the funnel portion 1. The difference between the widths $d_1$ and $d_2$ is an inherent result of the process used for manufacturing the funnel portion 1. Although the difference can be reduced to a certain extent, it cannot be completely eliminated. Particularly, when the funnel portion 1 is manufactured by a spinning method, the difference between width $d_1$ and $d_2$ is considerable. Therefore, each corner should be coated with more glass frit per unit length of end surface 1*a* than each straight portion of the latter.

Since, in the existing apparatus, the funnel portion 1 is rotated about its central axis at a constant relative speed between the end surface 1*a* and the outlet opening of the glass frit containing pot and the glass frit is discharged from the outlet opening of the glass frit containing pot at a constant rate, the coated layer of the glass frit is too thin at the corners of the end surface 1*a* of the funnel portion 1, or it is too thick at the straight portions of the end surface 1*a*. Heretofore, the thickness of the coated layer has been manually evened with a knife or a spatula. Such manual operation requires considerable skill. Further, the powder of the glass frit often scatters, and considerable investment is required for the prevention of polution of the environment thereby.

SUMMARY OF THE INVENTION

An object of this invention is to provide apparatus for applying a glass frit to a sealing edge of the funnel portion of a picture tube which overcomes the above-mentioned defects of the conventional coating apparatus.

Another object of this invention is to provide apparatus for applying a glass frit to a sealing edge of the funnel portion of a picture tube in which the amount of glass frit applied to each portion of the sealing edge is proportional to the width of such portion of the sealing edge.

The above and other objects, features and advantages of this invention will become apparent from the following detailed description of illustrative embodiments shown in the accompanying drawings.

BRIEF DESCRIPTION OF THE DRAWINGS

FIG. 1 is an exploded perspective view of a picture tube which is used for explanation of this invention;

FIG. 2 is a front view of a funnel portion of the picture tube of FIG. 1;

FIG. 3 is a perspective view of an apparatus for applying a glass frit to the sealing edge of the funnel portion, according to one embodiment of this invention, and which is shown partly broken away;

FIG. 4 is a plan view of a cam gear used in the apparatus of FIG. 3;

FIG. 5 is an enlarged cross-sectional view of the nozzle portion of a glass frit-containing pot in the apparatus of FIG. 3;

FIG. 6 is a schematic illustration of another embodiment of the invention; and FIG. 7 is a schematic illustration of still another embodiment of the invention.

DESCRIPTION OF THE PREFERRED EMBODIMENTS

Referring to FIG. 3, it will be seen that a funnel-neck holding cylinder 4 is mounted on a base frame 3. A rod 6 fitted with a chuck holding block 5 is rotatably supported by the cylinder 4. Moreover, the rod 6 is movable in the vertical direction.

A funnel portion 1 of a picture tube is supported by three supporting members 8 fixed on a mounting plate or turntable 7 in such a manner that the sealing edge or end surface 1*a* of the funnel portion 1 is facing upwardly. A cam or rack gear 10 is connected to the mounting plate 7 through four studs 9. The mounting plate 7 and the rack gear 10 have centrally located circular holes 7*a* and 1*a*, respectively. A neck portion 1*b* of the funnel portion 1 passes vertically through the circular holes 7*a* and 10*a*. The free end of the neck portion 1*b* is firmly held by a chuck 11 which is attached to the chuck holding block 5. The mounting plate or turntable 7 is rotatably supported at its periphery in an annular member 3*a* formed integrally with the base frame 3, and of which only one-half is shown in FIG. 3. The mounting plate or turntable 7 is supported on ball bearings (not shown) in an annular groove of the annular member 3*a*.

With the above described construction, the funnel portion 1, the mounting plate 7, the rack gear 8, the chuck 11, the chuck holding block 5 and the rod 6 can be rotated as a unit. The cam or rack gear 10 is provided with teeth 10*b* along its circumference. Such teeth 10*b* of the rack gear 10 engage with a pinion gear 12 fixed on a shaft 13 which is rotatably supported on one end of an L-shaped arm 14. The arm 14 is supported at its end by a supporting pin 15 so as to be rotatable relative to the base frame 3. A coil spring 16 is connected at one end to the pin 15 and, at its other end, to the arm 14 so as to urge the arm 14 counter-clockwise (FIG. 3) round the supporting pin 15, whereby to always engage the pinion gear 12 with the rack gear 10. A drive motor 17 is fixed on the arm 14. A synchro-timing belt 21 is wound around a drive pulley 19 on the shaft 18 of the drive motor 17 and an idle pulley 20 fixed on one end of the rotational shaft 13. Thus, rotation of the rotational shaft 18 of the drive motor 17 is transmitted to the pinion gear 12 engaged with the rack gear 10. As the result, the funnel portion 1 is rotated with the rack gear 10.

An air actuator 25 is fixed on a supporting member 22 mounted on the base frame 3 and is mounted on the air actuator 25 and rotatably supports a shaft 23*a.* A carriage arm 24 is fixed on the top end of the shaft 23*a.* The shaft 23*a* is urged in the rotational direction indicated by the arrow on FIG. 3 by the compressed air suitably supplied to the air actuator 25. A bearing box 30 is fixed on the free end of the carriage arm 24. A pot stirring motor 28 and a reduction gear 29 are supported on the bearing box 30 through a connecting cylindrical member 30*a.* A glass frit containing pot 26 is supported on the bearing box 30 through a connecting cylindrical member 30*b.* The rotational shaft of the reduction gear 29 for the pot stirring motor 28 passes through the connecting cylindrical member 30*a,* the bearing box 30 and the connecting cylindrical member 30*b.* A stirrer 27 is connected to the lower end of the rotational shaft of the reduction gear 29 within the glass frit containing pot 26. Thus, rotation of the pot stirring motor 28 is transmitted to the stirrer 27 at a reduced rate.

The glass frit containing pot 26 is arranged over the end surface 1*a* of the funnel portion 1 in such a manner that a nozzle 26*a* formed at the lower end of the glass frit containing pot 26 faces the end surface 1*a* of the funnel portion 1. A shutter or valve 33 is arranged under the nozzle 26*a,* and is connected to a drive rod of a shutter drive cylinder 32 which is suspended from a supporting member 31 fixed on the carriage arm 24. As is apparent from FIG. 5, the shutter 33 has a circular hole 33*a* so that, when the nozzle 26*a* is aligned with the circular hole 33*a* of the shutter 33, the glass frit can be discharged from the glass frit containing pot 26. A follower or guide portion 26*b* is formed integrally with the glass frit containing pot 26 adjacent to the nozzle 26*a,* and it is always pressed against the outside marginal portion 1*c* of the funnel portion 1 by the action of the air actuator 25, as is apparent from FIG. 5.

Referring now to FIG. 4 which shows a plan view of the rack gear 10, it will be seen that a figure defined by four straight sides 10S and four corners appearing in dotted lines is similar to the circumference of the sealing edge 1*a* of the funnel portion. Four projections 10*c,* 10*d,* 10*e* and 10*f* are formed on the corners of the rack gear 10. The four straight sides 10*s* and four projections 10*c,* 10*d,* 10*e* and 10*f* have teeth 10*b* extending continuously.

The operation of the above-described apparatus will now be described.

The pinion gear 12 is rotated by the drive motor 17 so as to cause rotation of rack gear 10. When the pinion gear 12 is engaged with a straight side 10*s* of each gear 10, the funnel portion 1 is rotated in such a manner that the relative speed between the nozzle 26*a* of the glass frit containing pot 26 and the straight side of the end surface 1*a* of the funnel portion 1 is constant. However, when the rack gear 10 is engaged with the pinion gear 12 at a corner projection 10*c,* 10*d,* 10*e* or 10*f,* the funnel portion 1 is rotated in such a manner that the relative speed between the nozzle 26*a* of the glass frit containing pot 26 and the corner portion of the end surface 1*a* of the funnel portion 1 is lower than the relative speed therebetween at the straight side of the end surface 1*a* of the funnel portion 1. Since the glass frit is discharged to the end surface 1*a* of the funnel portion 1 from the nozzle 26*a* of the glass frit containing pot 26 at a constant flow rate, the end surface 1*a* of the funnel portion 1 receives more glass frit at the corners than at the straight sides. As the result, the corners of the end surface 1*a* having a relatively larger width $d_1$ are coated with the same thickness of glass frit as the straight sides of the end surface 1*a* having a smaller width $d_2$.

According to this invention, the amount of glass frit applied to the sealing or end surface 1*a* is adjusted in accordance with the width of the end surface of the funnel portion by controlling the rotational speed of the funnel portion so that the relative speed between the nozzle and the end surface of the funnel portion is substantially inversely proportional to the width of the end surface of the funnel portion. The application of this invention is not limited to the end surface 1*a* of the funnel portion 1 having different widths as shown on FIG. 2.

According to another embodiment of the invention shown schematically of FIG. 6, the distribution of the width of the end surface 1*a* of the funnel portion 1 is previously examined or measured, and the results of the examination are memorized in a memory device 100. Then, the rotational speed of the drive motor 17A for rotating the funnel portion is controlled by a servo-control 101 in response to output signals of the memory device 100.

According to a further embodiment of this invention shown schematically of FIG. 7, the width of the end surface 1*a* of the funnel portion 1 may be detected by a detecting device 200 during the coating operation, and the rotational speed of the drive motor 17B for rotating the funnel portion 1 is servo-controlled by output signals from the detecting device 200. For example, the detecting device 200 may comprise two follower rollers 200*a* and 200*b* pinching the end surface 1*a* of the funnel portion therebetween. One follower roller 200*a* follows the inside marginal portion of the funnel portion 1, while the other follower roller 200*b* follows the outside marginal portion 1*c* of the funnel portion 1. The distance between the two follower rollers 200*a* and 200*b* varies with the width of the end surface 1*a* of the funnel portion 1. The rotational speed of the drive motor 17B is controlled by a servo-control 201 in response to the output signal of the detecting sevice 200 which corresponds to the distance between the follower rollers.

While preferred embodiments have been described, variations thereto will occur to those skilled in the art within the scope of the present inventive concepts which are delineated by the following claims.

What is claimed:

1. An apparatus for applying glass frit to an end surface of the funnel portion of a picture tube, which end surface is of varying width; said apparatus comprising a rotatable turntable for supporting said funnel portion with said end surface facing upwardly; a container for the glass frit having a nozzle at the bottom thereof for discharging the glass frit at a substantially constant rate; means supporting said container for positioning said nozzle over said end surface of the funnel portion; means for rotating said turntable and the funnel portion thereon; and means for varying the speed of rotation of said turntable in the course of each revolution thereof so that the relative speed between said nozzle and said end surface therebelow is varied substantially in inverse proportion to variations in said width of the end surface.

2. An apparatus according to claim 1; in which said means for rotating said turntable includes a drive motor and a pinion rotated by the latter; and said means for varying the speed of rotation of said turntable includes a cam gear rotatably coupled with said turntable and having a toothed periphery of predetermined irregular shape with which said pinion is engaged.

3. An apparatus according to claim 2; in which said end surface of the funnel portion is of generally rectangular configuration and has corner portions of relatively increased width, and said cam gear is of generally rectangular configuration and has rounded projections extending from its corner portions.

4. An apparatus according to claim 2; in which said means for rotating the turntable further includes a pivoted support arm for said drive motor and pinion, and means yieldably urging said support arm to pivot in the direction for maintaining engagement of said pinion with said toothed periphery of the cam gear.

5. An apparatus according to claim 1; in which said means supporting the container includes a pivoted arm which is swingable for moving said nozzle generally toward and away from the axis of said turntable, and means for urging said pivoted arm to swing in the direction for moving said nozzle toward said axis; and in which said container has a guide member depending therefrom adjacent said nozzle for engagement with the outer periphery of the funnel portion adjacent the end surface of the latter so as to position said nozzle over said end surface.

6. An apparatus according to claim 1; in which said means for varying the speed of rotation of the turntable includes memory means in which information concerning said varying width of the end surface is recorded.

7. An apparatus according to claim 1; in which said means for varying the speed of rotation of the turntable includes means for detecting the width of said end surface below said nozzle.

* * * * *